US006052060A

United States Patent [19]

Butler et al.

[11] Patent Number: 6,052,060

[45] Date of Patent: Apr. 18, 2000

[54] TEMPERATURE MONITOR FOR ELECTRICAL SWITCHGEAR

[75] Inventors: David McMahan Butler, Knoxville; Johnny James Clark, Maryville, both of Tenn.

[73] Assignee: Filmax, Inc., Loudon, Tenn.

[21] Appl. No.: 09/036,832

[22] Filed: Mar. 9, 1998

[51] Int. Cl.[7] ..... G08B 21/00

[52] U.S. Cl. ..... 340/644; 340/584; 340/646; 336/55; 336/57; 336/58

[58] Field of Search ..... 340/644, 645, 340/646, 584; 336/55, 57, 58

[56] References Cited

U.S. PATENT DOCUMENTS

| | | | |
|---|---|---|---|
| 2,340,898 | 2/1944 | Race | 174/14 R |
| 3,087,431 | 4/1963 | Bagwell | 417/9 |
| 3,371,299 | 2/1968 | Radkowski et al. | 336/57 |
| 4,192,174 | 3/1980 | Lobermann et al. | 73/19 |
| 4,232,551 | 11/1980 | Pierce | 361/36 |
| 4,337,820 | 7/1982 | Pierce | 165/11.1 |
| 4,437,082 | 3/1984 | Walsh et al. | 336/58 |
| 4,654,806 | 3/1987 | Poyser et al. | 340/646 |
| 4,745,571 | 5/1988 | Foster | 340/646 |
| 5,244,567 | 9/1993 | Gerteis | 210/86 |
| 5,360,033 | 11/1994 | Williams et al. | 137/565.16 |
| 5,534,853 | 7/1996 | Pioch | 340/646 |
| 5,691,706 | 11/1997 | Butler et al. | 340/646 |

*Primary Examiner*—Daniel J. Wu
*Attorney, Agent, or Firm*—W. Allen Marcontell

[57] ABSTRACT

Insulating oil in electric power transmission switchgear such as a load tap changer for a transformer is filtered for removal of accumulated water and carbon particles. The filter and associated circulation pump is usually located in a separate cabinet external to the switchgear with circulation conduits connecting the filter, the pump and the switchgear reservoir. To prevent or minimize equipment damage that is presaged by excessive insulating oil temperature, oil flow within the oil circulation conduits is monitored for temperature excesses. Alarms are issued and electrical loads are disconnected upon detection of an excess temperature event. If desired, provision may be made for disconnected the jeopardized equipment from its respective service load.

8 Claims, 4 Drawing Sheets

TEMPERATURE MONITOR FOR ELECTRICAL SWITCHGEAR

BACKGROUND OF THE INVENTION

The present invention generally relates to electric power transmission devices. More particularly, the invention relates to apparatus and methods for preventing equipment failures that are signified by overheated dielectric insulation oil.

Electric power transmission devices such as transformers and switch gear are often immersed in a specially compounded oil having dielectric properties for purposes of insulation, isolation and cooling. On occasion, these devices generate extremely high operating temperatures. Although the oil will not burn in the absence of atmosphere or oxygen, small portions will directly decompose under the intense heat of electrical arcing. This is especially true for load tap changers and similar switchgear wherein mechanical contact switches are routinely closed and opened with a high potential difference standing at the switch points. Such decomposition transforms the oil into elemental carbon, which remains in the remaining oil reservoir as suspended graphite particles.

With respect to equipment having pressure sealed oil reservoirs, the internal reservoir pressure increases as the oil heats under load and intense switching activity. Over time, seals and gaskets weaken to release the temperature induced pressure load by release of oil volume. Dielectric oil is believed to be an environmental hazard. Consequently, oil loss by leakage is to be avoided. Equally damaging, however, is the consequence of oil volume losses due to temperature induced pressure. When the electrical load activity causing the temperature/pressure increase subsides, the oil cools, contracts and depressurizes. To the extent that oil volume is expelled from the reservoir under high pressure, the void left by the displaced oil volume is filled under cool, negative pressure from the surrounding atmosphere. This atmosphere might enter the system through the same seal and gasket weaknesses that release oil from the reservoir in the first place. Carried with such induced atmosphere into the oil reservoir is water vapor. Since the chemical nature of the oil is hydrophilic, any atmospherically carried water coming into surface contact with the oil is adsorbed and entrained.

Unpressurized oil reservoirs are vented to the atmosphere. The operative consequence of an atmospheric vent is to admit atmospherically borne water vapor. By the same mechanism as previously described, water is adsorbed and entrained with the dielectric oil in unpressurized reservoirs.

Both, water droplets and graphite particles are intolerable contaminants of the oil and must be removed, either periodically or continuously. Fortunately, both contaminants are effectively removed by relatively simple, depth wound, unsized paper reel filters. A traditional load tap changer installation often will connect the oil reservoir for the load tap changer by external plumbing conduits to adjacently housed pump and filter units. Circulation around the conduit loop is driven by the pump motor which is controlled by cycle timers and filter pressure differential monitoring switches. Circulation may be continuous or intermittent, depending on the type of transformer or the service to which it is applied.

Transformer reservoirs are not usually filtered, or externally circulated while the transformer is operative or "on line". External filtration of the transformer oil may be performed by a portable apparatus that is connected to the oil reservoir for oil circulation through filtration devices for a predetermined time interval while the transformer is off-line. At the end of the filtration time interval, the portable circulation apparatus is disconnected and removed.

Due to the absence of switch contact activity within a transformer, a large reservoir volume and reservoir case fins normally keep the load induced temperature fluctuations of transformers within tolerable ranges. Although the oil reservoirs of load tap changers and similar switchgear are substantially smaller, the respective oil temperatures should remain substantially the same. The heat exchange rate of switchgear can usually be matched to the induced heat rate of load switching by pumped, external circulation and filtration. By engineered design, therefore, dielectric oil temperatures respective to transformers and associated switchgear are operationally matched and not normally perceived as a controlled parameter.

However, externally circulated switchgear oil, proportionately, has a considerably greater risk of loss and contamination due to the greater number of conduit connections and dynamic fluid seals.

It is, therefore, an object of the present invention to actively monitor the switchgear oil temperature.

Another object of the invention is to provide an excess oil temperature alarm signal system that is activated by one or more temperature sensors positioned in an oil filter circulation system that serves a transformer load tap changer.

Also an object of the present invention is an oil temperature monitoring system for transformer switchgear that disconnects the associated transformer from its load circuit when the switchgear oil temperature exceeds an acceptable limit.

A still further object of the invention is a system for monitoring the oil temperature differential respective to a transformer and the switchgear having a control association with the transformer.

SUMMARY OF THE INVENTION

These and other objects of the invention are provided by an insulating oil circulation system for transformer switchgear having a motor driven pump connected in fluid circuit with a filter unit. The pump, motor and filter assembly are preferably secured within an independent cabinet enclosure. Primary circulation conduits connect the filter and pump, respectively, with the oil filled reservoir of an associated electric power switchgear device such as a load tap changer, breaker, closure, reclosure, switch or switching bank. A full circulation loop preferably includes a conduit from the switchgear oil reservoir to the pump, a flow connection between the pump and the filter, a conduit between the filter and the switchgear oil reservoir and an internal flow connection within the switchgear oil reservoir between the pump conduit connection and the filter conduit connection.

A temperature sensor element is positioned within the circulation loop, preferably in the pump suction leg that receives the oil flow stream directly from the switchgear oil reservoir. Sensor signals corresponding to the oil temperature value are transmitted to a signal converter. Converted signals are compared to a set-point value. Converted signal values in excess of the set-point value initiate an audio/visual alarm having a known association to an excess temperature value for the switchgear oil reservoir.

An alternative embodiment of the invention includes a temperature sensor element positioned within the pump suction leg of the circulation loop as previously described.

Additionally, however, a converted signal value from the signal converter in excess of a set-point value initiates a disconnect signal command to the load tap changer thereby isolating the switchgear/transformer unit from the line load. Such load disconnection signal may also initiate an alarm command similar to the first embodiment of the invention.

A second alternative to the invention relies upon signals from a pair of temperature sensor elements. The first sensor element is preferably located in the pump suction leg of the load tap changer oil circulation loop. A second sensor element preferably includes a deep penetration probe into the internal volume of the associated transformer reservoir. Corresponding signals from the two sensor elements are compared and the differential compared to a set-point differential. Differential values exceeding the set-point initiate a first command signal to disconnect the line load from the transformer and a second command signal to initiate a corresponding alarm.

BRIEF DESCRIPTION OF DRAWINGS

The advantages and further aspects of the invention will be readily appreciated by those of ordinary skill in the art as the same becomes better understood by reference to the following detailed description when considered in conjunction with the accompanying drawings in which.

DESCRIPTION OF THE PREFERRED EMBODIMENT

Figure 1:
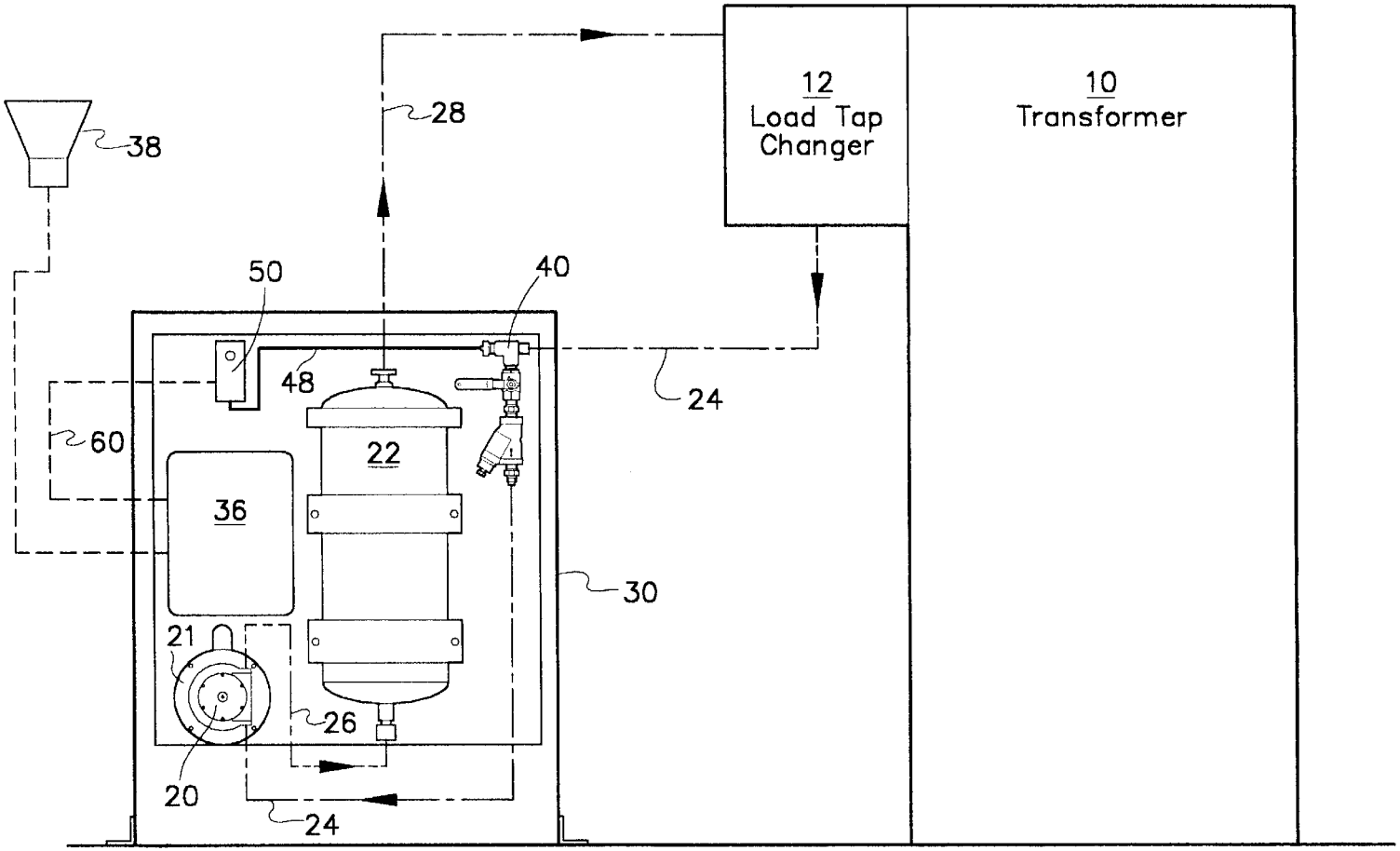
FIG. 1 is a schematic of a first embodiment of the present invention.
Figure 2:
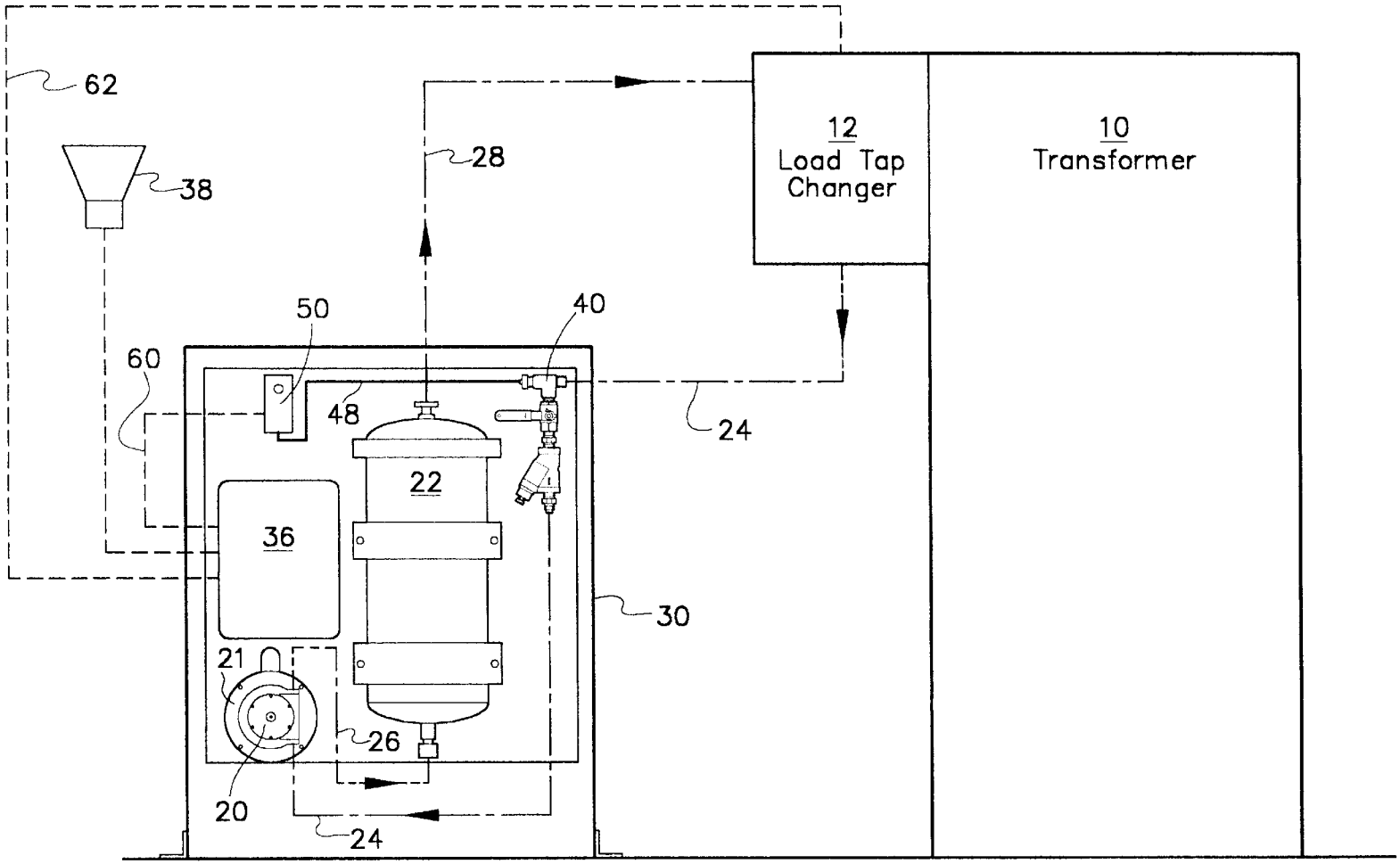
FIG. 2 is a schematic of a second embodiment of the invention.
Figure 3:
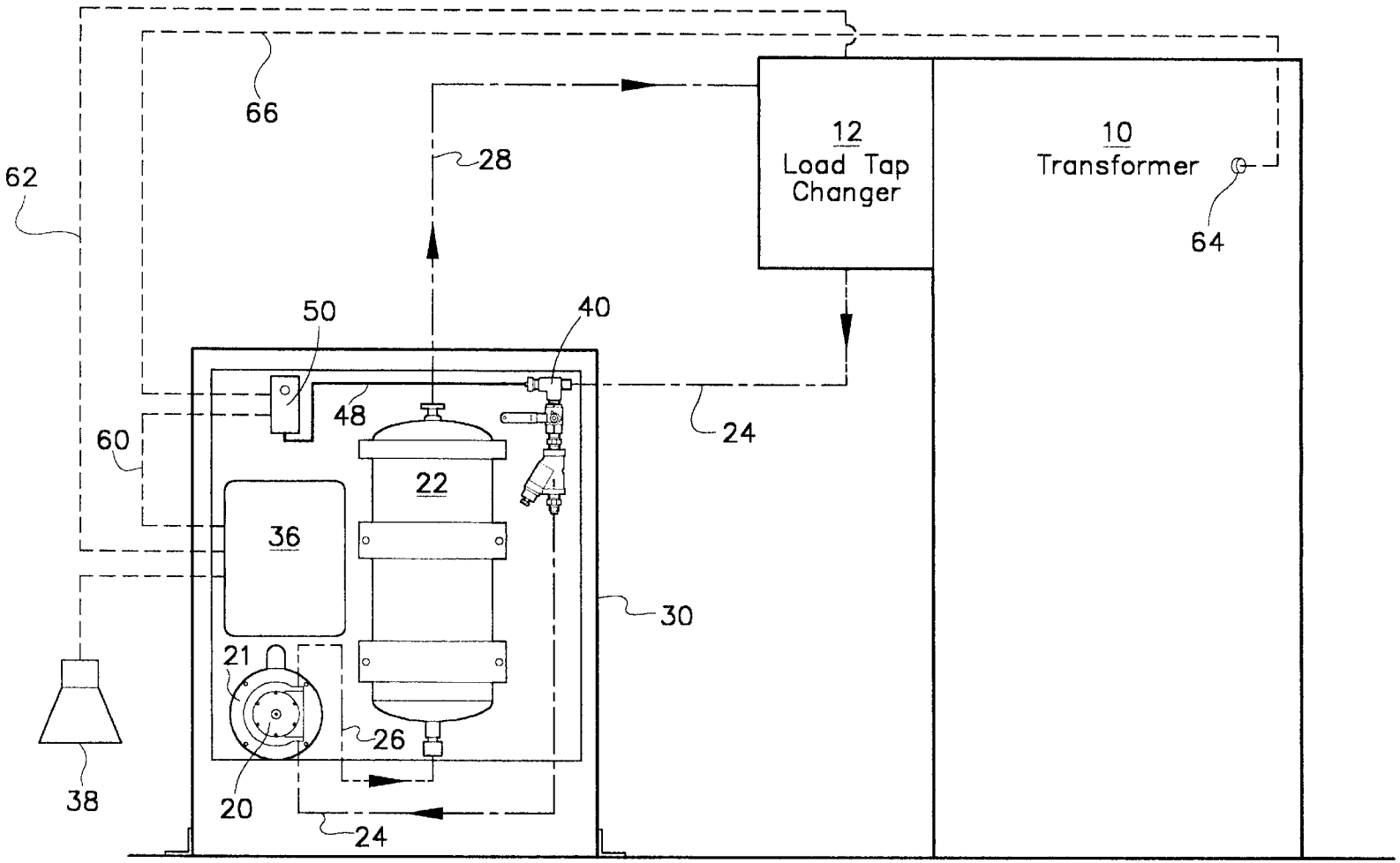
FIG. 3 is a schematic of a third embodiment of the invention.

Relative to the drawings wherein like reference characters designate like or similar elements throughout the several figures of the drawings, FIGS. 1, 2 and 3 schematically illustrate a fluid circuit of the invention supporting the load tap changer 12 for an electric power transformer 10. Typically, such a power transformer stands about 10 to 14 ft. high with a nominal diameter or rectangular side dimension of 3 to 6 feet across. The load tap changer 12 is merely representative of many types of electric power switchgear devices that further include breakers, closures, reclosures and switches.

Each transformer casement is usually externally finned for heat dissipation and sealed to prevent loss and leakage of internal fluids which immerse a plurality of core and winding assemblies. The internal fluid is an oil substance, not necessarily petroleum based, but moderately viscous and highly dielectric to insulate the several winding sets from arcing between themselves and the transformer case. Localized heating of the oil stimulates internal convective circulation which transfers the heat generated by electrical transform losses to the outer case for conduction therethrough to the exterior dissipation fins. Pumps and radiators may also be used to cool the insulating oil but generally the oil is confined within a closed case reservoir.

The load tap changer 12 is a mechanical switching array by which the transformer output is regulated for line and load demand. The electrical arcing usually incident to the closure and opening of charged electrical contacts is a momentary point source of extreme heat. Such extreme heat in the presence of the insulating oil generates particulate graphite from dissociation of the oil. This particulate graphite contaminates the oil body and contributes to a reduction of the dielectric property of the oil. For reasons which amount to a greater propensity for contaminant generation, a load tap changer oil reservoir of 300 to 800 gallons capacity is frequently isolated from the oil reservoir respective to the transformer winding case. Other switchgear devices such as breakers, closures, reclosures and switch boxes may encase 50 gal. to 200 gal. of dielectric insulating oil.

Typically, the load tap changer insulating oil is circulated by a positive displacement pump 20, such as a gear pump, through a filtration unit 22. Conduit leg 24 provides a fluid flow channel between the load tap changer oil reservoir and the pump 20 suction connection. Pump discharge conduit 26 connects to the inlet of filter 22. Return conduit 28 carries the oil circulation flow loop back to load tap changer 12.

The pump 20 and its associated electric motor 21, the filter 22 and the related electric control panel 36 are preferably housed within a cabinet enclosure 30 which is generally located closely adjacent to the load tap changer 12. The control panel 36 isolates and organizes those electrical and electronic devices that control the motor 21 operation as to pumping and filtration cycles. Additionally, oil circulation pressures within the pump suction are 24, pump discharge line 26 and the filtered return conduit 18 are monitored for predetermined safe operating ranges. Pressure monitor signals are transmitted to the control panel 36 for conversion and set-point comparison. Predetermined signal values and value differentials initiate alarm devices 38 represented by a horn schematic. Other alarms such as lights, sirens and bells may be activated.

Figure 4:
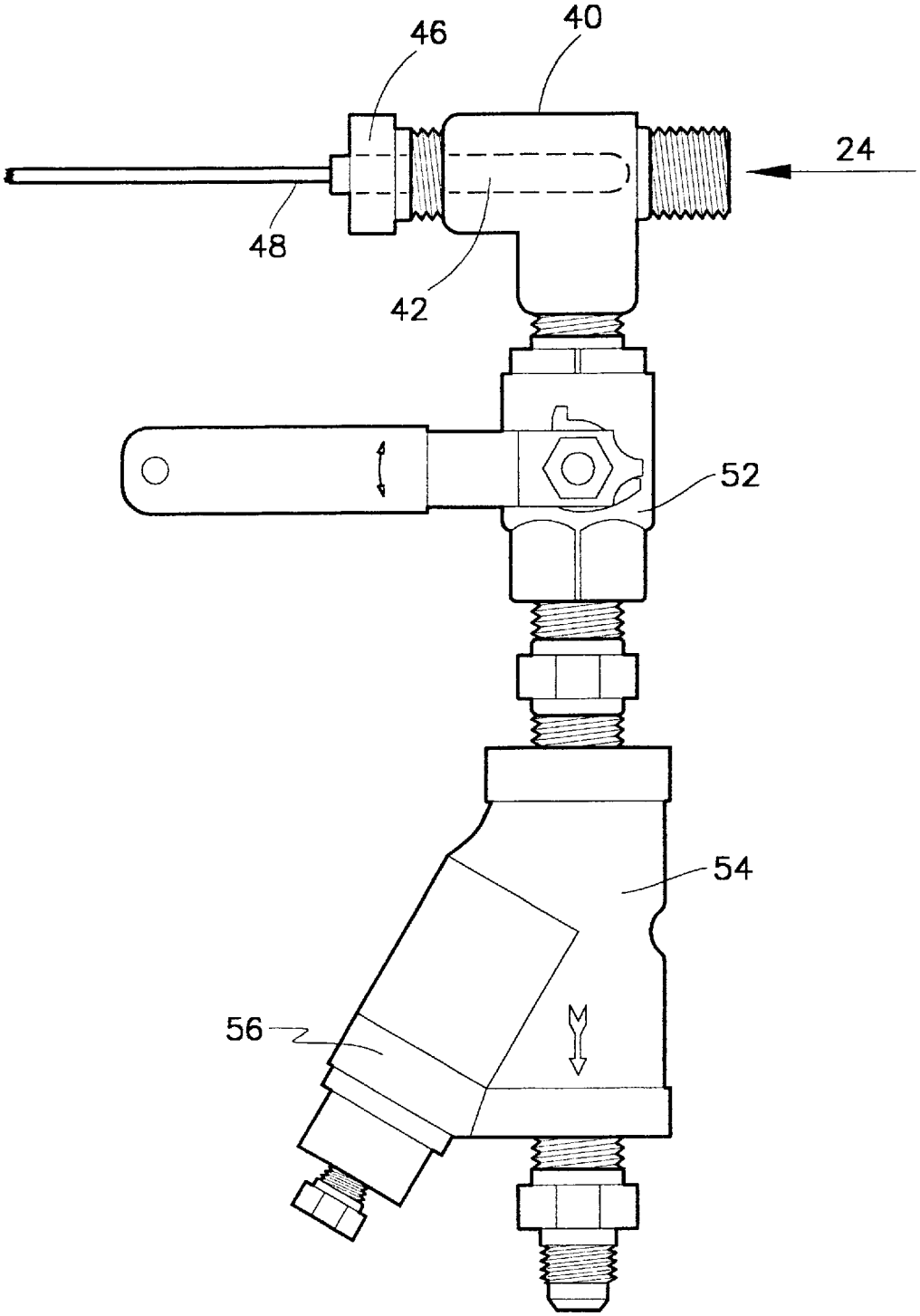
FIG. 4 is a detail of a temperature sensor assembly.

With respect to FIG. 4, the pump suction conduit 24 is connected to a temperature probe fitting 40. A threaded collet plug 46 secures and seals a temperature sensing probe 42 within the fluid flow stream formed within the fitting 40. Signal carrier 48 connects the sensing probe 42 to a signal converter 50. Downstream of the probe fitting 40, the suction line 24 may include a valve 52 and a wye strainer 54 having a cleaning leg 56.

Oil circulated from the load tap changer 12 flows around and in wet contact with the probe 42 to stimulate signals carried through the carrier conduit 48. These signals from the probe 42 have a correspondence to the temperature of the circulated oil. Signal converter 50 receives the probe 42 signals for processing into a form acceptable to a set point comparison circuit in panel 36. Such signal conversion may include amplification and/or analog to digital translation. In any case, signals corresponding to the temperature of oil arriving from the load tap changer 12 are transmitted via conductor 60 to a set-point comparison circuit in control panel 36. The set-point comparison circuit has operational control over the alarm system 38 in the event that set-point values are exceeded.

With respect to FIG. 2, substantially the same sensing and control system is disclosed with the addition of an affirmative response signal 62 from the set-point comparison circuit. As a further consequence of an oil temperature value that exceeds the set-point norms, signal 62 is issued to actuate relays within the load tap changer 12 that disconnect the transformer 10 from imposed loads. Accordingly, greater heating of the load tap changer oil is prevented.

The system of FIG. 3 exploits a temperature probe 64 similar to the probe 42. The probe 64 is preferably positioned deeply within the reservoir volume of transformer 10. Temperature related signals from the probe 64 are transmitted along conduit 66 to the signal converter 50. Here, the signals 66 may be compared to the signals 48 from the circulation probe 42 and the difference transmitted by conduit 60 to the set-point comparison circuit in panel 36. In this case, the comparison value is a predetermined temperature differential value between the oil in transformer 10 and the oil circulated through load tap changer 12. Since the two oils should operate at substantially the same temperature, the tolerable differential should be small. When exceeded, however, the embodiment of FIG. 3 initiates a line load disconnection signal 62 as well as an alarm signal 38.

The foregoing description of the preferred embodiments of our invention have been presented for purposes of illustration and description. These embodiments are not intended to be exhaustive or to limit the invention to the precise forms disclosed. Obvious modifications or other variations are possible in light of the above teachings. The embodiments were chosen and described to provide the best illustration of the principles of the invention and its practical application and to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

As our invention, therefore

We claim:

1. The combination of:

an electric power switchgear apparatus having a dielectric oil reservoir;

an oil filter assembly external of said oil reservoir;

a dielectric oil circulation system comprising pump means and conduits external of said reservoir for circulating oil from said oil reservoir through said oil filter assembly;

oil temperature monitoring means comprising sensor means disposed within said external conduits for sensing the temperature of oil circulating through said circulation system and generating signals corresponding thereto; and, alarm means for comparing the monitoring means signals to a set-point value and emitting an alarm response to an oil temperature value exceeding said set-point value.

2. A combination as described by claim 1 wherein said oil circulation system comprises a first conduit external of said reservoir for channeling dielectric oil from said reservoir to said pump means, a second conduit external of said reservoir for channeling dielectric oil from said pump means to said oil filter assembly and a third conduit external of said reservoir for channeling dielectric oil from said oil filter assembly to said reservoir, said sensor means being disposed within an oil flow channel respective to said first conduit.

3. The combination of:

an electric power switchgear means for connecting an electric power transformer to an electric load, said switchgear means having a dielectric oil reservoir containing dielectric oil;

an oil filter assembly external of said oil reservoir;

a dielectric oil circulation system comprising pump means and conduits external of said oil reservoir for circulating oil from said oil reservoir through said oil filter assembly and back to said oil reservoir;

oil temperature monitoring means comprising sensor means disposed within said external conduits for sensing the temperature of oil circulating through said circulation system and generating signals corresponding thereto; and, switchgear control means for comparing the temperature monitoring means signals to a set-point value and disconnecting said power transformer from said electric load when the temperature monitoring means signals represent and oil temperature value that exceeds said set-point value.

4. A combination as described by claim 3 wherein said oil circulation system comprises a first conduit external of said reservoir for channeling dielectric oil from said reservoir to said pump means, a second conduit external of said reservoir for channeling dielectric oil from said pump means to said oil filter assembly and a third conduit external of said reservoir for channeling dielectric oil from said oil filter assembly to said reservoir, said sensor means being disposed within an oil flow channel respective to said first conduit.

5. A combination as described by claim 4 wherein said switchgear control means further initiates an alarm response to an oil temperature value that exceeds said set-point value.

6. The combination of:

an electric power transformer having a closed volume reservoir substantially filled with dielectric oil;

first oil temperature monitoring means for measuring the temperature of dielectric oil within said closed volume reservoir and generating first signals corresponding thereto;

an electric power switchgear means having a switchgear reservoir for dielectric oil;

an oil filter assembly external of said switchgear reservoir;

a dielectric oil circulation system comprising pump means and conduits external of said switchgear reservoir for circulating oil from said switchgear reservoir through said oil filter assembly and back to said switchgear reservoir;

second oil temperature monitoring means comprising sensor means disposed within said conduits external of said switchgear reservoir for sensing the temperature of oil circulating through said circulation system and generating second signals corresponding thereto; and, control means responsive to a differential value between said first and second signals exceeding a set-point for emitting an alarm response to such a differential value.

7. The combination as described by claim 6 wherein said oil circulation system comprises a first conduit external of said reservoir for channeling dielectric oil from said reservoir to said pump means, a second conduit external of said reservoir for channeling dielectric oil from said pump means to said oil filter assembly and a third conduit external of said reservoir for channeling dielectric oil from said oil filter assembly to said reservoir, said sensor means being disposed within an oil flow channel respective to said first conduit.

8. The combination as described by claim 6 wherein said control means disconnects said transformer from said electric load when said differential value exceeds said set-point value.

* * * * *